US008862033B2

(12) United States Patent
Takashima et al.

(10) Patent No.: US 8,862,033 B2
(45) Date of Patent: Oct. 14, 2014

(54) DRIVE TRANSMISSION STRUCTURE, DEVELOPER TRANSPORT DEVICE, AND IMAGE FORMING APPARATUS

(75) Inventors: Yoshiyuki Takashima, Kanagawa (JP); Tomonori Sato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 81 days.

(21) Appl. No.: 13/541,958

(22) Filed: Jul. 5, 2012

(65) Prior Publication Data

US 2013/0243490 A1 Sep. 19, 2013

(30) Foreign Application Priority Data

Mar. 16, 2012 (JP) ..... 2012-059820

(51) Int. Cl.
*G03G 15/08* (2006.01)

(52) U.S. Cl.
USPC ..... 399/258; 399/254; 399/262

(58) Field of Classification Search
CPC ..... G03G 15/8789; G03G 21/1647; G03G 21/1676; G03G 21/105; G03G 21/12
USPC ..... 399/120, 254–256, 258, 262, 358, 359
See application file for complete search history.

(56) References Cited

U.S. PATENT DOCUMENTS

| | | | | |
|---|---|---|---|---|
| 5,708,952 | A * | 1/1998 | Taniguchi et al. | 399/358 |
| 6,366,755 | B1 | 4/2002 | Takashima | |
| 7,110,705 | B2 * | 9/2006 | Harumoto | 399/258 |
| 7,127,207 | B2 * | 10/2006 | Tsurusaki | 399/359 |
| 2010/0242650 | A1 * | 9/2010 | Koga et al. | 74/416 |

FOREIGN PATENT DOCUMENTS

| | | | | |
|---|---|---|---|---|
| JP | 5-94122 | A | 4/1993 | |
| JP | 7-152260 | A | 6/1995 | |
| JP | 2001-296731 | A | 10/2001 | |
| JP | 2009229543 | A * | 10/2009 | G03G 15/08 |

* cited by examiner

*Primary Examiner* — David Gray
*Assistant Examiner* — Carla Therrien
(74) *Attorney, Agent, or Firm* — Sughrue Mion, PLLC

(57) ABSTRACT

A drive transmission structure includes a driven shaft, a drive shaft, and a bearing member. The driven shaft has a drive receiving gear attached thereto and a first shaft portion near the drive receiving gear, to which a rotational force is transmitted. The drive shaft has a drive transmitting gear attached thereto and a second shaft portion near the drive transmitting gear. The drive transmitting gear is engaged with the drive receiving gear so as to transmit the rotational force. The bearing member has a first bearing and a second bearing, which respectively support the first shaft portion and the second shaft portion. In the drive transmission structure, the axis of the drive shaft does not intersect and is non-parallel to the axis of the driven shaft, and the first and second bearings are integrally formed with the bearing member.

4 Claims, 9 Drawing Sheets

DRIVE TRANSMISSION STRUCTURE, DEVELOPER TRANSPORT DEVICE, AND IMAGE FORMING APPARATUS

CROSS-REFERENCE TO RELATED APPLICATIONS

This application is based on and claims priority under 35 USC 119 from Japanese Patent Application No. 2012-059820 filed Mar. 16, 2012.

BACKGROUND (i) Technical Filed

The present invention relates to a drive transmission structure, a developer transport device, and an image forming apparatus.

(ii) Related Art

Some drive transmissions using gears include a drive transmitting gear and a drive receiving gear engaged with each other so as to transmit a driving force, the axes of the gears being non-parallel and not intersecting each other. In image forming apparatuses such as copiers and printers that form an image made of a particulate developer, gears, the axes of which are non-parallel and do not intersect each other, are used, for example, to transmit rotational force to a rotation axis of a developer transport member, which has a transport portion transporting the developer in a structural portion through which the developer is transported (moved) from one location to another location.

SUMMARY

According to an aspect of the invention, a drive transmission structure includes a driven shaft, a drive shaft, and a bearing member. The driven shaft has a drive receiving gear attached thereto and a first shaft portion near the drive receiving gear, to which a rotational force is transmitted. The drive shaft has a drive transmitting gear attached thereto and a second shaft portion near the drive transmitting gear. The drive transmitting gear is engaged with the drive receiving gear so as to transmit the rotational force. The bearing member has a first bearing and a second bearing, which respectively support the first shaft portion and the second shaft portion. In the drive transmission structure, the axis of the drive shaft does not intersect and is non-parallel to the axis of the driven shaft, and the first and second bearings are integrally formed with the bearing member.

BRIEF DESCRIPTION OF THE DRAWINGS

Exemplary embodiments of the present invention will be described in detail based on the following figures, wherein:

FIG. 9 is a perspective view of part of the developer replenishment device (the transport pipe, the drive transmission device, and so forth) illustrated in FIG. 4 seen from a direction at an angle different from the angle at which FIG. 8 is seen;

FIG. 12 illustrates the bearing member of the drive transmission device seen from a direction at an angle different from the angle at which FIG. 11 is seen.

DETAILED DESCRIPTION

Exemplary embodiments in which the present invention is implemented (referred to as "exemplary embodiment" or "exemplary embodiments" hereafter) will be described below with reference to the drawings.

First Exemplary Embodiment

Figure 1:
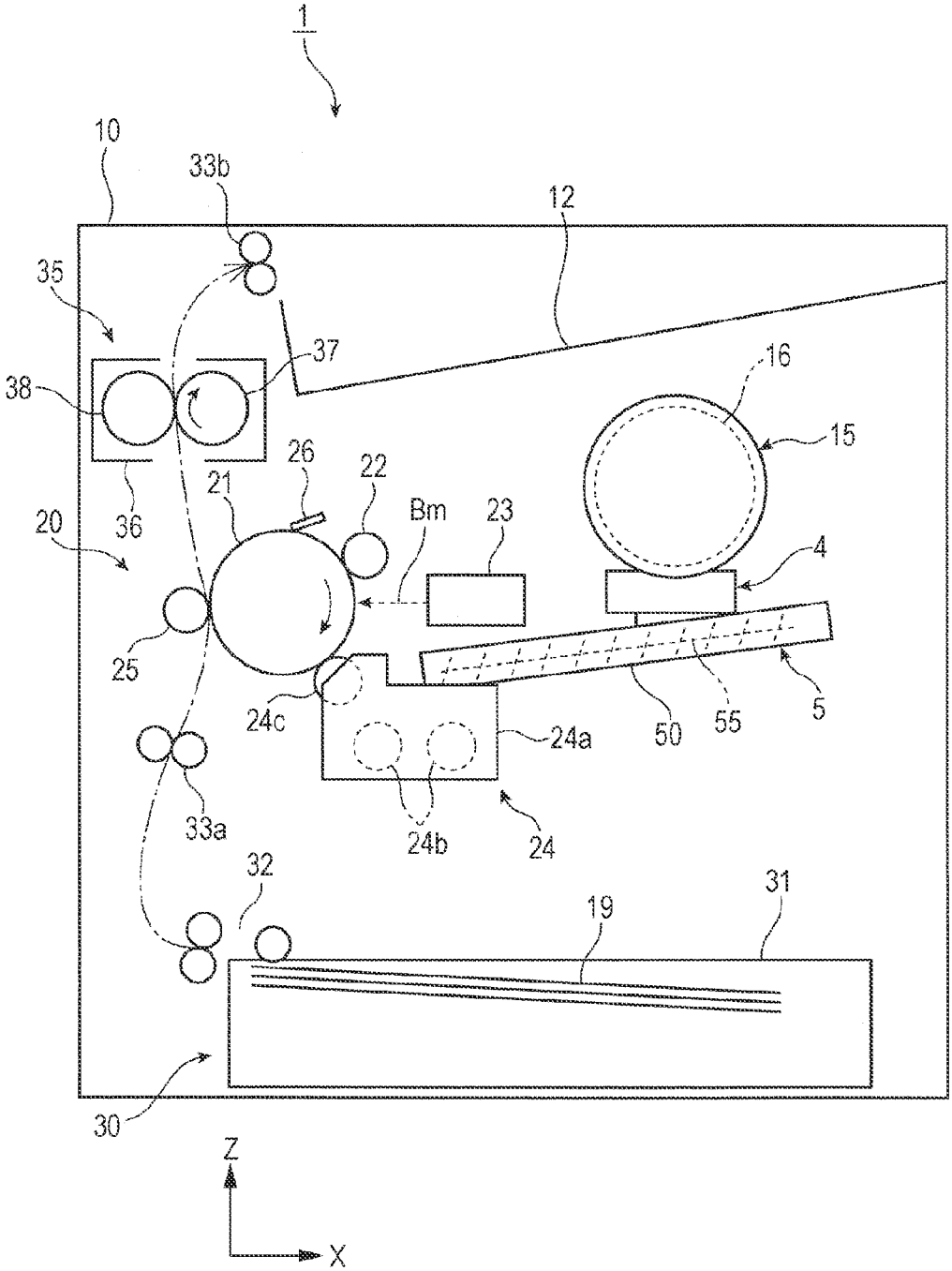
FIG. 1 illustrates an outline of an image forming apparatus according to a first exemplary embodiment.
Figure 2:
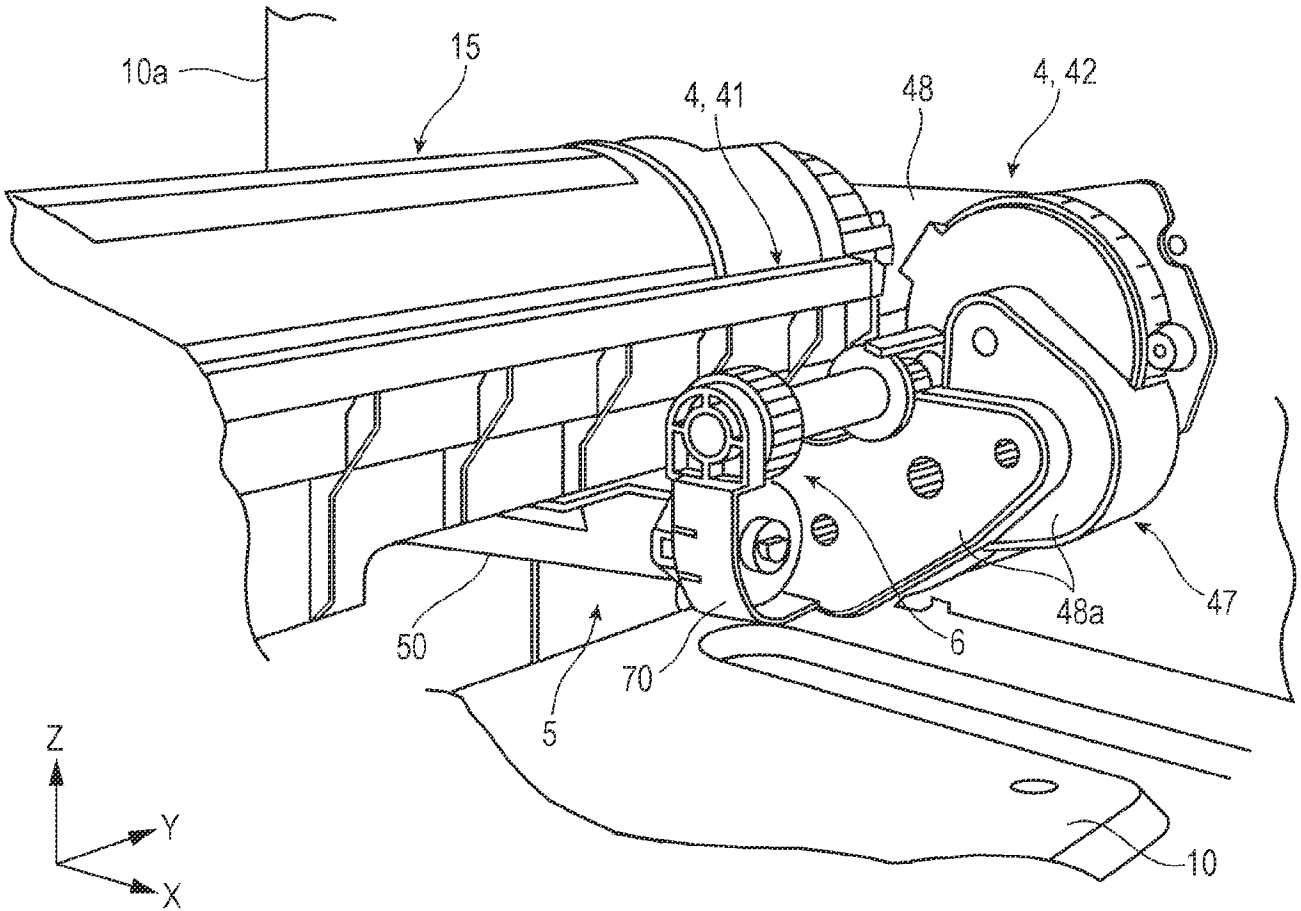
FIG. 2 is a perspective view of part (a developer replenishment device, a developer transport device, and so forth) of the image forming apparatus illustrated in FIG. 1.
Figure 3:
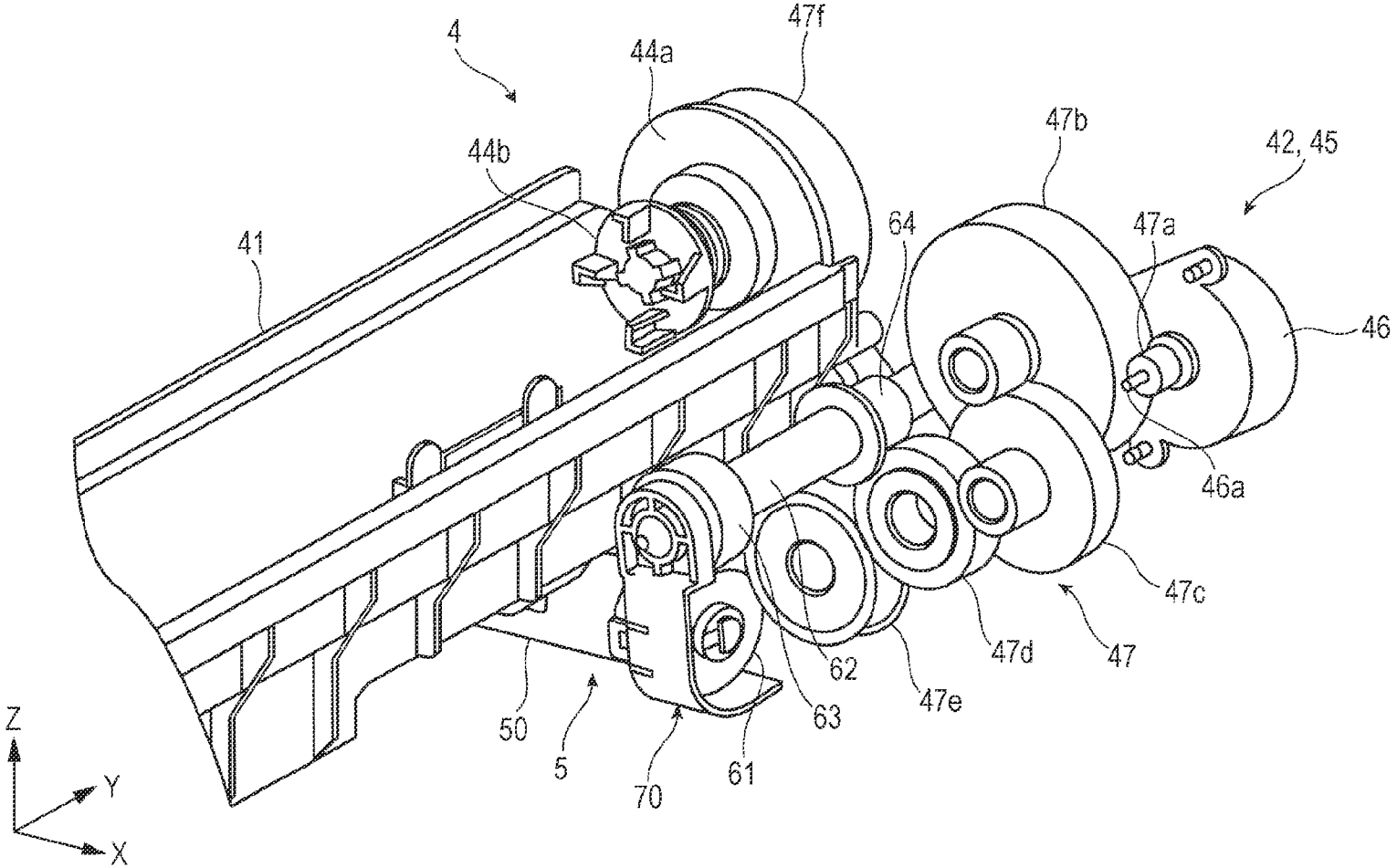
FIG. 3 is an enlarged perspective view of part of the developer replenishment device and the developer transport device illustrated in FIG. 2.
Figure 4:
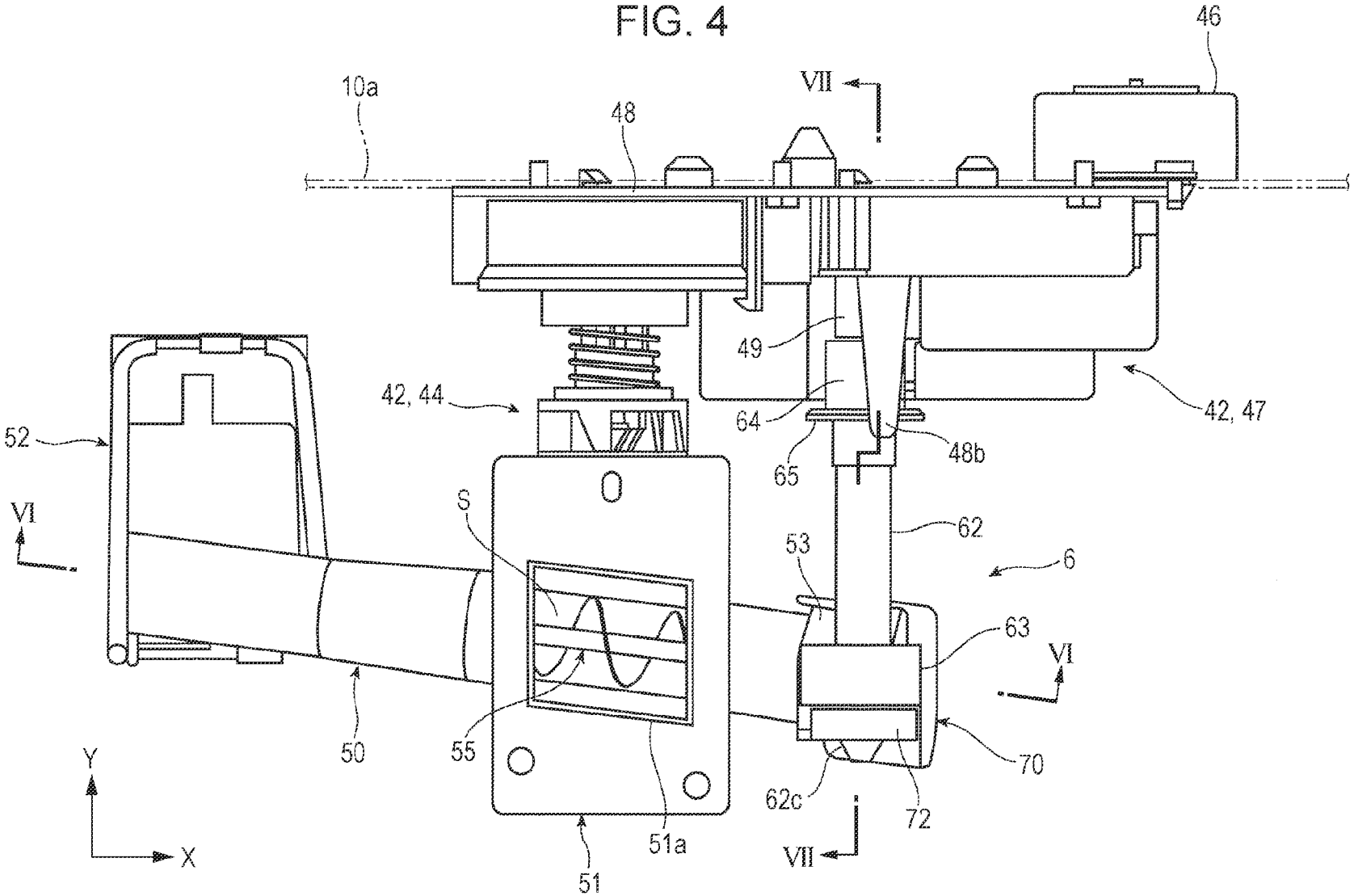
FIG. 4 is a top plan view of part of the developer replenishment device and the developer transport device illustrated in FIG. 2 (with a replenishment container and a container attachment portion removed)
Figure 5:
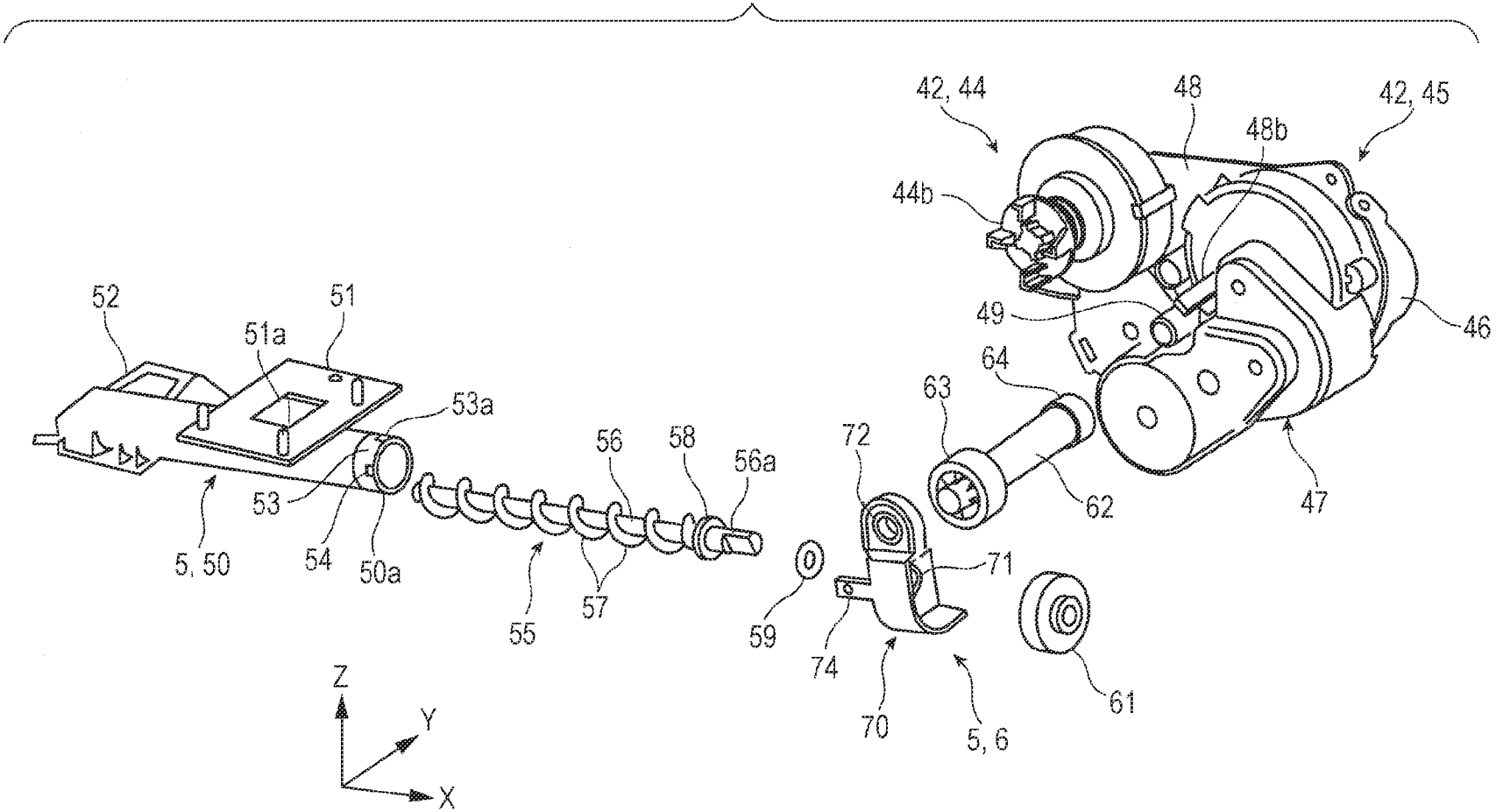
FIG. 5 is an exploded perspective view of the developer replenishment device and the developer transport device illustrated in FIG. 4.

FIG. 1 illustrates an outline of an image forming apparatus equipped with a developer transport device according to a first exemplary embodiment. FIG. 2 illustrates part (a developer replenishment device, a developer transport device, and so forth) of the image forming apparatus. FIG. 3 illustrates part of the developer replenishment device and the developer transport device illustrated in FIG. 2. FIG. 4 is a top plan view of the developer transport device. FIG. 5 is an exploded view of the developer transport device illustrated in FIG. 4.

Fundamental Structure of Image Forming Apparatus

As illustrated in FIG. 1, an image forming apparatus 1 according to the first exemplary embodiment includes a housing 10, an image forming unit 20, a sheet feeder 30, and a fixing device 35. The housing 10 is formed of a structural member, an exterior member, and so forth. The image forming unit 20 forms an image made of toner, the toner serving as a developer, and finally transfers the formed toner image onto recording paper 19, which is an example of a recording medium. The sheet feeder 30 is loaded with the recording paper 19, which is transported and fed to the image forming unit 20. The fixing device 35 fixes the toner image having been transferred onto the recording paper 19. The housing 10 houses the image forming unit 20, the sheet feeder 30, the fixing device 35, and so forth therein.

The image forming unit 20 includes components such as a photoconductor drum 21, a charger 22, an exposure device 23, a developing device 24, a transfer device 25, a cleaner 26, and so forth. The photoconductor drum 21 rotates in a direction indicated by an arrow (clockwise direction) in FIG. 1. The charger 22 causes a peripheral surface of the photoconductor drum 21 (a portion of a surface serving as an image forming area) to be charged at a required potential. The exposure device 23 emits a beam (Bm) to the peripheral surface of the photoconductor drum 21 in accordance with image information (signal) after the photoconductor drum 21 has been charged so as to form an electrostatic latent image having a potential difference. The developing device 24 develops the electrostatic latent image using the toner as the developer so as to form the toner image. The transfer device 25 transfers the toner image onto the recording paper 19. The cleaner 26 removes the toner and the like remaining on the surface of the photoconductor drum 21 from which the toner image has been transferred.

The photoconductor drum 21 includes, for example, a grounded cylinder-shaped electrically conductive base member having an outer peripheral surface, on which a photodielectric layer made of an organic photosensitive material or the like is formed. The charger 22 uses a charging roller that rotates while contacting the photoconductor drum 21. The exposure device 23 emits a beam in accordance with an image signal, which is obtained by performing a required process on image information using an image processing device (not shown). The image information is input from an image information supplying source such as a document reader, an external unit, or a storage medium reader, which is connected to or provided in the image forming apparatus 1.

The developing device 24 is made to be a developing device that uses a developer including, for example, a toner and carrier. The developing device 24 includes a container-shaped housing 24*a*,which has a containing portion that contains the developer and has agitating and transporting members 24*b* such as screw augers that rotate in the containing portion of the housing 24*a*. The developer is agitated by the agitating and transporting members 24*b* while being transported in a state in which the developer is circulated, so that the developer passes an area where a developing roller 24*c* exists. Part of the developer is held by the developing roller 24*c* that rotates near an opening of the housing 24*a* so as to be supplied to a developing area that opposes the photoconductor drum 21. The toner serving as the developer contained in the developing device 24 is charged to a required polarity due to friction with the carrier.

The transfer device 25 uses a transfer roller that rotates while contacting the photoconductor drum 21. The cleaner 26 uses a plate-shaped cleaning member or the like that contacts the peripheral surface of the photoconductor drum 21. At a required time such as a time when an image is formed (an image forming operation is performed), a charger voltage, a developing voltage, and a transfer voltage are respectively supplied to the charging roller of the charger 22, the developing roller 24*c* of the developing device 24, and the transfer roller of the transfer device 25 from a power unit (not shown).

The sheet feeder 30 includes a sheet container 31 and a delivery device 32. Plural sheets of recording paper 19 of a required size, type, and the like to be used to form images are loaded in the sheet container 31 such that the sheets of recording paper 19 are stacked one on top of another. The sheet container 31 is of a tray type, a cassette type, or the like. The delivery device 32 delivers the sheets of recording paper 19 loaded in the sheet container 31 one sheet after another. Plural sheet containers 31 are provided in accordance with a form of application. The sheet feeder 30 delivers a sheet of the recording paper 19 at each timing at which a sheet of the recording paper 19 is to be supplied (fed). A dotted-chain line with an arrow in FIG. 1 indicates a typical transport path of the recording paper 19. Plural paper transport roller pairs 33*a* and 33*b*,a transport guide member (not shown), and so forth are arranged along the transport path.

The fixing device 35 includes a heating rotating member 37, a pressurizing rotating member 38, and so forth provided in a housing 36. The heating rotating member 37, which is in the form of a roller, belt, or the like, rotates in a direction indicated by an arrow in FIG. 1. The surface temperature of the heating rotating member 37 is increased to and maintained at a required temperature by a heating unit. The pressurizing rotating member 38, which is in the form of a roller, belt, or the like, contacts the heating rotating member 37 substantially in the axial direction of the heating rotating member 37 at a required pressure and is rotated by the heating rotating member 37. The fixing device 35 allows the recording paper 19, onto which the toner image has been transferred, to pass through a fixing process portion formed between the heating rotating member 37 and the pressurizing rotating member 38 so as to fix the toner image onto the recording paper 19.

Fundamental Image Forming Operation

The image forming apparatus 1 forms an image as follows. Here, as an example, a fundamental image forming operation in which an image is formed on a side of a sheet of the recording paper 19 is described.

Upon reception of a start command for image forming operation (printing), initially in the image forming unit 20 of the image forming apparatus 1, the photoconductor drum 21 starts to rotate and the surface of the photoconductor drum 21 is charged to a specified polarity and a specified potential by the charger 22. After that, the charged surface of the photoconductor drum 21 is exposed to a beam emitted from the exposure device 23 in accordance with image information, thereby forming an electrostatic latent image having a specified potential difference. Then, when the electrostatic latent image formed on the photoconductor drum 21 passes the developing device 24, toner charged to a required polarity and supplied from the developing roller 24*c* adheres to the electrostatic latent image. Thus, the electrostatic image is developed to a toner image.

After that, due to rotation of the photoconductor drum 21, the toner image formed on the photoconductor drum 21 is transported to a transfer position at which the toner image opposes the transfer device 25. The toner image is transferred by the transfer device 25 onto a side of the sheet of recording paper 19, which has been supplied from the sheet feeder 30 through the transport path at the timing at which the toner image has been transported to the transfer position. The peripheral surface of the photoconductor drum 21, from which the toner image has been transferred, is cleaned by the cleaner 26.

Then, the sheet of recording paper 19 onto which the toner image has been transferred is detached from the photoconductor drum 21 and transported so as to be introduced into the fixing device 35. The sheet of recording paper 19 is heated and pressurized while passing through the fixing process portion between the heating rotating member 37 and the pressurizing rotating member 38 of the fixing device 35. Thus, the toner image, which has not been fixed, is fixed in a fused state. The sheet of recording paper 19 onto which the toner image has been fixed is transported to and contained in an ejected sheet accommodating unit 12 or the like formed, for example, in part of the housing 10.

Thus, a monochrome image made of a toner of a single color has been formed on a side of the sheet of the recording paper 19 and a fundamental image forming operation is completed. In the case where the image forming operation in which an image is formed on plural sheets is demanded, the above-described series of operations will be repeatedly performed in a similar manner as many times as the demanded number of sheets.

Other Structures Provided in Image Forming Apparatus

As illustrated in, for example, FIGS. 1 and 2, the image forming apparatus 1 includes in the housing 10 a developer replenishment device 4 and a developer transport device 5. The developing device 24 of the image forming unit 20 is replenished with the developer from the developer replenishment device 4. The developer with which the developing device 24 is replenished is transported from the developer replenishment device 4 to the developing device 24 by the developer transport device 5.

Structure and Operation of Developer Replenishment Device

The developer replenishment device 4 includes a container attachment portion 41 and a drive transmission device 42. A cylinder-shaped replenishment container 15 contains a developer (for example, only toner) for replenishment and is detachably attached to the container attachment portion 41. The replenishment container 15 has a transport member 16 disposed therein having, for example, a coil shape. The transport member 16 rotates so as to transport the developer in the replenishment container 15 toward an outlet port. The drive transmission device 42 transmits rotational force to the transport member 16 of the replenishment container 15 attached to the container attachment portion 41. The replenishment container 15 has a rotation connection device (such as sprocket, not shown) that receives an external rotational force for the transport member 16. The rotation connection device is not covered and disposed at one end portion of the replenishment container 15.

The container attachment portion 41 is disposed at a required position (an upper position relative to the developing device 24 in the direction of gravitational force in the first exemplary embodiment) in the housing 10. As illustrated in, for example, FIG. 3, the container attachment portion 41 includes a gutter-shaped holding member that can detachably hold the cylinder-shaped replenishment container 15. An outlet hole 43 (see FIG. 6) is formed at a position of the bottom of the holding member, the position corresponding to the outlet port of the replenishment container 15. The developer passes through the outlet hole 43 so as to be fed. The holding member is attached such that the holding member is secured to part of the housing 10 (for example, a side wall plate 10*a*).

The drive transmission device 42 includes a rotation connection board 44 and rotation drive device 45. The rotation connection board 44 is removably connected to the rotation connection device disposed at the one end portion of the replenishment container 15 so as to transmit the rotational force. The rotation drive device 45 transmits the rotational force to the rotation connection board 44 at a required timing. The rotation connection board 44 includes a rotation support unit 44*a* and a connection body unit 44*b*. The connection body unit 44*b* is attached to the rotation support unit 44*a* such that the connection body unit 44*b* is slightly elastically movable relative to the rotation support unit 44*a* in the axial direction and elastically pressed against the rotation connection device of the replenishment container 15. The rotation drive device 45 includes a motor 46 as a drive source and a drive transmission mechanism 47, which actually transmits the rotational force of the motor 46 to the rotation connection board 44.

As illustrated in FIG. 3, the drive transmission mechanism 47 includes plural reduction gear trains. Gears of the gear trains are sequentially engaged with one another as follows: A drive gear 47*a* attached to a drive shaft 46*a* of the motor 46 is engaged with a two-step compound first transmission gear 47*b*,the two-step compound first transmission gear 47*b* is engaged with a two-step compound second transmission gear 47*c*,the two-step compound second transmission gear 47*c* is engaged with a third transmission gear 47*d*,the third transmission gear 47*d* is engaged with a fourth transmission gear 47*e*,. . . and at last, a final transmission gear 47*f* is engaged. The rotation connection board 44 and the rotation drive device 45 (the motor 46 and the transmission gears of the drive transmission mechanism 47) are supported by a support plate 48, which has a protection covering 48*a* of the drive transmission mechanism 47. The support plate 48 is attached to the side wall plate 10*a*,which is part of the housing 10, so as to be supported by the side wall plate 10*a*. The transmission gears of the drive transmission mechanism 47 are rotatably attached to respective support shafts provided on the support plate 48. Reference numeral 48*a* in, for example, FIG. 2 denotes the protection covering, which is attached to the support plate 48 and covers the transmission gears of the drive transmission mechanism 47.

The developer replenishment device 4 operates as follows.

That is, when, for example, information is transmitted from a detector, which detects the remaining amount of the developer in the developing device 24, to a controller of the developer replenishment device 4, the drive transmission device 42 rotates for a required period of time in accordance with the detection information. This causes the rotational force of the drive transmission device 42 to be transmitted to the rotation connection board 44 through the drive transmission mechanism 47, thereby rotating the rotation connection board 44 in a required direction for a required period of time. As a result, the transport member 16 disposed in the replenishment container 15, which is attached to the container attachment portion 41, rotates for a required period of time, and accordingly, the transport member 16 transports the developer for replenishment contained in the replenishment container 15 toward the outlet port and discharges (feeds) the developer such that the developer drops onto the developer transport device 5 through the outlet port.

Configuration of Developer Transport Device

The developer transport device 5 includes at least a transport pipe 50, a developer transport member 55, and a drive transmission device 6. The transport pipe 50 has a cylinder-shaped transport space S formed therein, which connects the outlet hole 43 of the container attachment portion 41 to a developer receiving port for replenishment (not shown) of the developing device 24 and allows the developer to be transported therethrough. The developer transport member 55 rotates in the transport space S of the transport pipe 50 so as to transport the developer received from the developer replenishment device 4 to the developing device 24 side. The drive transmission device 6 transmits the rotational force to the developer transport member 55.

As illustrated in, for example, FIGS. 1 and 2, the transport pipe 50 is disposed at a lower position relative to the container attachment portion 41 and slightly inclined. A first connection unit 51 is provided in a portion of the transport pipe 50 opposite the container attachment portion 41. The first connection unit 51 is used for connection with the outlet hole 43 of the container attachment portion 41. The first connection unit 51 has an opening 51*a* formed therein, which opposes the outlet hole 43 and is connected to the transport space S. A second connection unit 52 is provided in a portion of the transport pipe 50 (an end portion of the transport pipe 50 at a lower position relative to the first connection unit 51 in the direction of gravitational force) opposite the developing device 24. The second connection unit 52 is used for connection with the developer receiving port (not shown) of the developing device 24. The second connection unit 52 has an opening 52*a* formed therein, which opposes the developer receiving port of the developing device 24 and is connected to the transport space S.

The transport pipe 50 is attached such that, for example, the first connection unit 51 of the transport pipe 50 is secured to the container attachment portion 41 and the second connection unit 52 of the transport pipe 50 is secured to part of the housing 24*a* of the developing device 24. As illustrated in, for example, FIG. 6, the transport pipe 50 has a coupling portion 53 formed at an end portion 50*a* thereof. The coupling portion 53 is engaged with a bearing member 70 of the drive transmission device 6, thereby being connected to the bearing member 70. The bearing member 70 will be described later. The coupling portion 53 is, for example, a cylinder-shaped large diameter portion of the transport pipe 50 having an outer diameter larger than those of other portions of the transport pipe 50.

The developer transport member 55 has a bar-shaped rotation shaft 56 and a transport blade 57 that transports developer. The transport blade 57 spirally continuously protrudes from and extends along a peripheral surface of the rotation shaft 56 in a required range. A portion of the developer transport member 55 in which the transport blade 57 is formed is housed in the transport space S of the transport pipe 50. An end portion 56*a* of the rotation shaft 56 in which the transport blade 57 is not formed protrudes outward from the end portion 50*a* of the transport pipe 50. The developer transport member 55 has a disc portion 58 having a large diameter formed at the end portion 56*a* of the rotation shaft 56. The disc portion 58 may suppress an unnecessary movement of the developer along the peripheral surface of the rotation shaft 56 for the developer.

The drive transmission device 6 uses the gears, which are engaged with each other and the axes of which are non-parallel and do not intersect each other, so as to transmit the rotational force. Specifically, the drive transmission device 6 includes a drive receiving gear 61, a drive shaft 62, a drive transmitting gear 63, and a bearing member 70. The drive receiving gear 61 is secured to the end portion 56*a* of the rotation shaft 56 of the developer transport member 55. The drive shaft 62 is arranged substantially perpendicular to the rotation shaft 56, which serves as a driven shaft. The axis of the drive shaft 62 does not intersect and is non-parallel to the axis of the rotation shaft 56. The drive transmitting gear 63 is secured to the drive shaft 62 and engaged with the drive receiving gear 61 so as to transmit the rotational force to the drive receiving gear 61. The bearing member 70 has a first bearing 71 and a second bearing 72, which are integrally formed with the bearing member 70. The first bearing 71 supports a portion of the rotation shaft 56 near the drive receiving gear 61 (part of the end portion 56*a*). The second bearing 72 supports a portion of the drive shaft 62 near the drive transmitting gear 63 (part of an end portion 62*c*).

Figure 7:
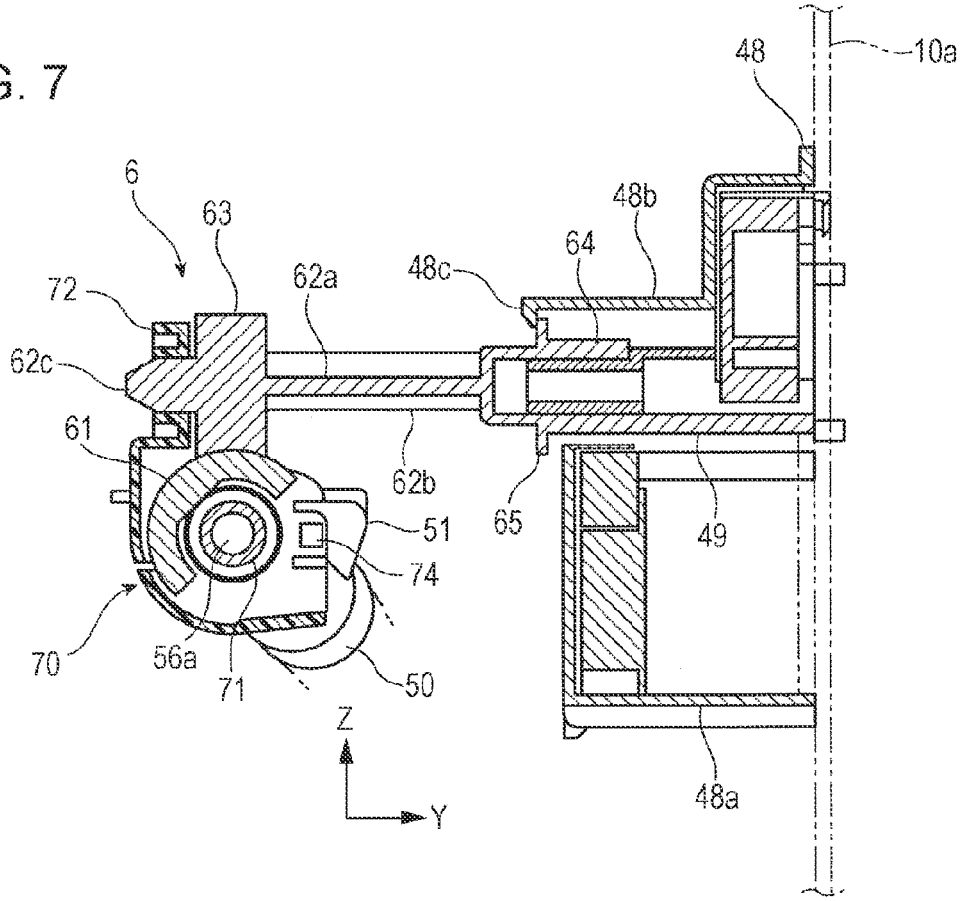
FIG. 7 is a general sectional view of the developer replenishment device and the developer transport device illustrated in FIG. 4 taken along line VII-VII in FIG. 4.

Part of the rotational force of the rotation drive device 45 of the developer replenishment device 4 is transmitted so as to rotate the drive shaft 62. In particular, as illustrated in FIG. 7, the drive shaft 62 has a two-part structure: a shaft body 62*a* and a rotation support portion 62*b*,by which the shaft body 62*a* is rotatably supported. The drive transmitting gear 63 is attached to the end portion 62*c* of the shaft body 62*a*,and a transmission input gear 64 is attached to the other end portion of the shaft body 62*a*. The transmission input gear 64 is engaged with the third transmission gear 47*d* of the drive transmission mechanism 47 of the rotation drive device 45. Thus, part of the rotational force of the rotation drive device 45 is transmitted via the transmission input gear 64. The shaft body 62*a* of the drive shaft 62 is fitted onto a support shaft 49 provided on the support plate 48 of the developer replenishment device 4 so as to be connected to and rotatably supported by the support shaft 49. The rotation support portion 62*b* is secured as follows: that is, an end hook portion 48*c* of a retainer piece 48*b*,the retainer piece 48*b* being formed so as to protrude and extend from the protection covering 48*a* of the drive transmission mechanism 47, is hooked to a large diameter portion 65 of the rotation support portion 62*b*,the large diameter portion 65 being formed near the transmission input gear 64.

As illustrated in, for example, FIGS. 6 to 12, the bearing member 70 has a first side surface portion 70*a*,on which an annular-shaped coupling portion 73 is formed so as to protrude outward from the first side surface portion 70*a*. The coupling portion 53 of the transport pipe 50 is fitted onto the coupling portion 73. The bearing member 70 has the cylinder-shaped first bearing 71 formed at a central portion of the coupling portion 73 thereof. The first bearing 71 protrudes in a direction opposite (inward) to a direction in which the coupling portion 73 protrudes. The bearing member 70 also has the cylinder-shaped second bearing 72 at an upper position relative to the first side surface portion 70*a* and a second side surface portion 70*b*,which is continuous with part of the first side surface portion 70*a*. The direction of the second bearing 72 is substantially perpendicular to the direction in which the cylindrical shape of the first bearing extends so that the directions of the first and second bearings 71 and 72 match the positional relationship of the axes, which are non-parallel and do not intersect each other. The bearing member 70 has a bottom surface portion 70*c* formed on the bottom sides of the first and second side surfaces 70*a* and 70*b*. The bottom surface portion 70*c* is continuous with the first and second side surface portions 70*a* and 70*b* (see FIGS. 8 and 12).

Figure 11:
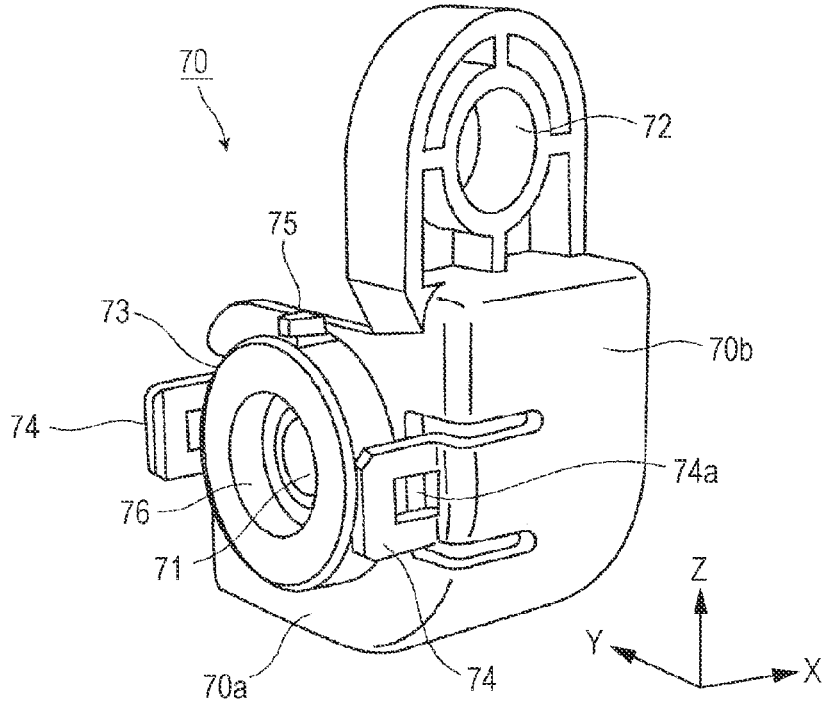
FIG. 11 is a perspective view of a bearing member of the drive transmission device seen from a direction at a certain angle.
Figure 12:
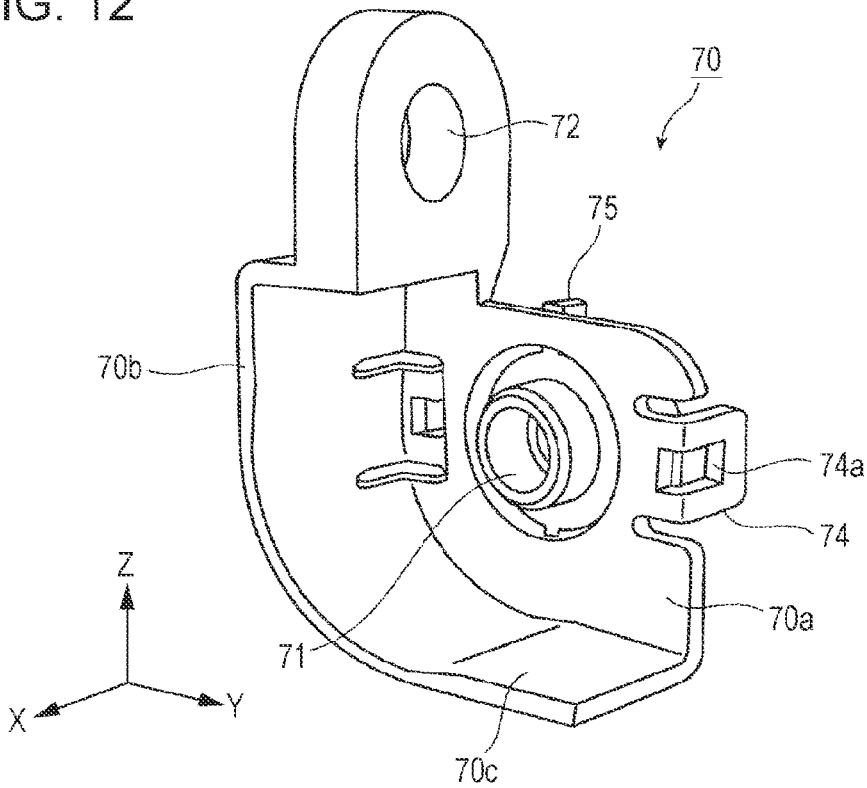

As illustrated in, for example, FIG. 11, the bearing member 70 has a pair of connection pieces 74 formed on the first side surface portion 70*a* thereof. The connection pieces 74 protrude in substantially the same direction as that of the coupling portion 73 and secure a state in which the bearing member 70 is connected to the transport pipe 50. An engagement hole 74*a* is formed at an end portion of each connection piece 74. Connection securing protrusions 54 (see FIG. 5), which are formed on an outer peripheral surface of the transport pipe 50, are fitted into the respective engagement holes 74*a* when the bearing member 70 is connected to the transport pipe 50.

Furthermore, as illustrated in, for example, FIG. 11, the bearing member 70 has a positioning protrusion 75 formed on an outer peripheral portion of the coupling portion 73 thereof. The positioning protrusion 75 is fitted into a cut portion 53*a* formed in the coupling portion 53 of the transport pipe 50 and secured when the bearing member 70 is connected to the transport pipe 50. The cut portion 53*a* may instead have a groove shape. A cylinder-shaped recess 76 is formed on a front side (side connected to the transport pipe 50) of the first bearing 71 at a central portion of the coupling portion 73. The diameter of the recess 76 is larger than that of the end portion 56*a* of the rotation shaft 56 of the developer transport member 55. An annular-shaped shielding member (sealant) 59 is attached to the recess 76 (see FIG. 6). The shielding member 59 closes, when the bearing member 70 is connected to the transport pipe 50, the gap formed between the coupling portion 73 and the end portion 56*a* of the rotation shaft 56. The shielding member 59 is used to prevent the developer from penetrating into the first bearing 71.

Such a bearing member 70 is formed of, for example, a desired material such as synthetic resin using such a method as resin molding. Thus, a structure (molded product) is obtained, with which the first bearing 71 and the second bearing 72 are integrally formed. The first bearing 71 and the second bearing 72 respectively supports the end portion 56*a* of the rotation shaft 56 and the end portion 62*c* of the shaft body 62*a* of the drive shaft 62, the axes of which are non-parallel and do not intersect each other.

Figure 6:
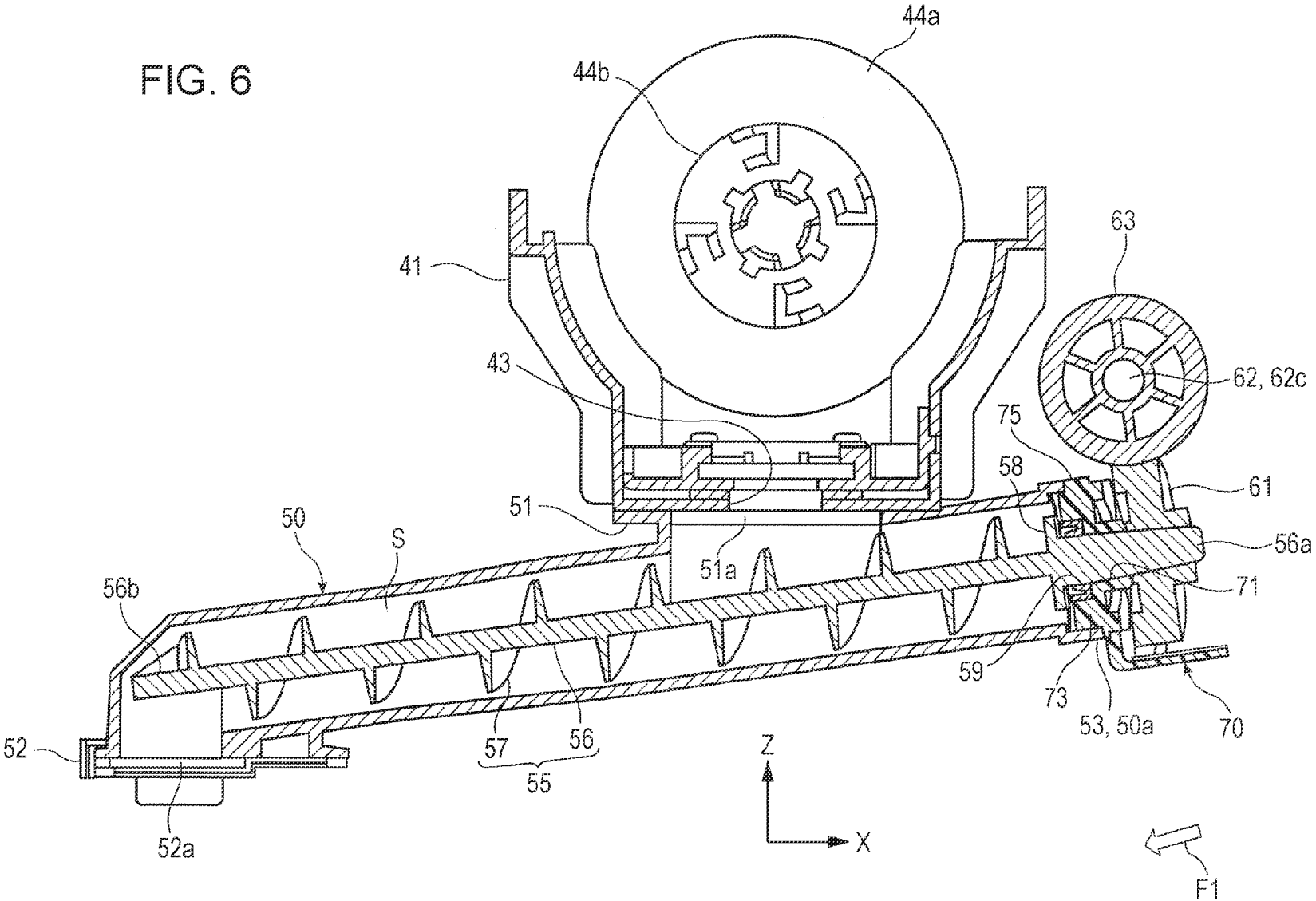
FIG. 6 is a sectional view of the developer replenishment device and the developer transport device illustrated in FIG. 4 taken along line VI-VI in FIG. 4.

As illustrated in, for example, FIG. 6, with the drive transmission device 6, the end portion 56*a* of the rotation shaft 56 of the developer transport member 55 is inserted into and rotatably supported by the first bearing 71 of the bearing member 70, which is connected to the coupling portion 53 of the transport pipe 50. Furthermore, the drive receiving gear 61 is secured to the end portion 56*a* of the rotation shaft 56, which is supported by and protrudes from the first bearing 71 of the bearing member 70.

The end portion 56*a* of the rotation shaft 56 is supported by the first bearing 71 of the bearing member 70 as follows: the rotation shaft 56 is attached to the bearing member 70 such that the shielding member 59, through which the end portion 56*a* of the rotation shaft 56 is inserted, is located in the recess 76 formed in the coupling portion 73 of the first bearing 71 (see FIG. 6). When the end portion 56*a* of the rotation shaft 56 is supported by the first bearing 71 of the bearing member 70, the disc portion 58 provided on the end portion 56*a* of the rotation shaft 56 opposes the coupling portion 73 of the first bearing 71 (see FIGS. 6 and 10). Thus, a movement of the developer existing in the transport space S of the transport pipe 50 toward the first bearing 71 of the bearing member 70 may be suppressed by the disc portion 58, and finally prevented by the shielding member 59 in a reliable manner. As a result, the developer may be prevented from penetrating into the first bearing 71.

The bearing member 70 is attached and connected to the transport pipe 50 by fitting the coupling portion 73 of the bearing member 70 into the coupling portion 53 of the transport pipe 50. In so doing, the connection securing protrusions 54 formed in the coupling portion 53 of the transport pipe 50 are hooked in the engagement holes 74*a* of the connection pieces 74 of the bearing member 70. Thus, the bearing member 70 is finally secured to the transport pipe 50 (see, for example, FIG. 9). In so doing, the positioning protrusion 75 formed on the coupling portion 73 of the bearing member 70 is fitted into the cut portion 53*a* formed in the coupling portion 53 of the transport pipe 50 (see FIGS. 6 and 9). Thus, the bearing member 70 is attached to the transport pipe 50 while the bearing member 70 is correctly positioned relative to the transport pipe 50.

In the developer transport device 5, the drive shaft 62 is inserted into and rotatably supported by the second bearing 72 of the bearing member 70 connected to the coupling portion 53 of the transport pipe 50. Furthermore, the drive transmitting gear 63 is secured to the end portion 62*c* of the drive shaft 62, which is supported by and protrudes from the second bearing 72 of the bearing member 70. The end portion 62*c* of the drive shaft 62 may be integrally formed with the drive transmitting gear 63.

The end portion 62*c* of the drive shaft 62 is supported by the second bearing 72 of the bearing member 70 by fitting the end portion 62*c* of the drive shaft 62 into a cylinder-shaped hole of the second bearing 72. Thus, the end portion 62*c* of the drive shaft 62 is supported by the second bearing 72 (see FIGS. 7 to 9). In so doing, the end of the drive shaft 62 opposite to the end to which the drive transmitting gear 63 is attached is fitted onto the support shaft 49 so as to be rotatably supported by the support shaft 49 (see FIG. 7). Also in so doing, the drive transmitting gear 63 of the drive shaft 62 is engaged with the drive receiving gear 61 exposed from the first bearing 71 of the bearing member 70. Furthermore, the transmission input gear 64 of the drive shaft 62 is engaged with the third transmission gear 47*d* of the drive transmission mechanism 47 of the rotation drive device 45 (see FIG. 3). The drive receiving gear 61 and the drive transmitting gear 63 are helical gears.

The drive transmission device 6 of the developer transport device 5 is assembled as described above.

Operation of Developer Transport Device, etc.

The developer transport device 5 operates as follows.

That is, as described above, when the developer replenishment device 4 operates, the drive transmission device 42 thereof rotates for a required period of time. When the drive transmission device 42 rotates, as described above, the rotational force of the drive transmission device 42 is partially transmitted through the required transmission gears of the drive transmission mechanism 47 to the drive shaft 62 (transmission input gear 64) of the drive transmission device 6 of the developer transport device 5, thereby rotating the drive shaft 62 in a required direction for a required period of time. Then, the rotational force transmitted to the drive shaft 62 of the drive transmission device 6 is transmitted from the drive transmitting gear 63 attached to the drive shaft 62 to the rotation shaft 56 of the developer transport member 55 via the drive receiving gear 61. The axes of the drive shaft 62 and the rotation shaft 56 are non-parallel and do not intersect each other.

As a result, the developer transport member 55 is rotated in a required direction for a required period of time in the transport space S of the transport pipe 50 of the developer transport device 5. Thus, the developer for replenishment having been fed from the developer replenishment device 4 through the opening 51*a* of the first connection unit 51 into the transport space S of the transport pipe 50 is transported toward the developing device 24 using the transport blade 57 of the developer transport member 55 in the transport space S. The developer having been transported by the developer transport member 55 is finally discharged through the opening 52*a* of the second connection unit 52 so as to drop through the opening 52*a*. At last, the developing device 24 is replenished with the developer transported through the developer receiving port of the developing device 24 so as to be stored in the housing 24*a* of the developing device 24.

In the drive transmission device 6 of the developer transport device 5, the axes of the rotation shaft 56 of the developer transport member 55 and the drive shaft 62 are non-parallel and do not intersect each other. Despite this, the first bearing 71 that supports the end portion 56*a* of the rotation shaft 56 and the second bearing 72 that supports the end portion 62*c* of the drive shaft 62 are integrally formed with the bearing member 70. Thus, the rotation shaft 56 and the drive shaft 62, the axes of which are non-parallel and do not intersect each other, are precisely positioned by the bearing member 70. The drive receiving gear 61 and the drive transmitting gear 63, which are respectively attached to the precisely positioned rotation shaft 56 and drive shaft 62, are also precisely positioned. Furthermore, the rotation shaft 56 and the drive shaft 62, the axes of which are non-parallel and do not intersect each other, are supported by the integrally formed bearing member 70. Thus, compared to a case in which the rotation shaft 56 and the drive shaft 62 are individually supported by separately formed bearings, the rotation shaft 56 and the drive shaft 62 are supported with the strengths of the rotation shaft 56 and the drive shaft 62 maintained.

Accordingly, with the drive transmission device 6, transmission efficiency is maintained because the rotation shaft 56 and the drive shaft 62, the axes of which are non-parallel and do not intersect each other, are precisely positioned. Furthermore, the rotation shaft 56 and the drive shaft 62 are positioned while the strengths thereof are ensured. This may prevent occurrence of problems such as tooth skipping due to separation of the drive receiving gear 61 and drive transmitting gear 63, which are respectively attached to the rotation shaft 56 and the drive shaft 62, from each other. In this way, with the drive transmission device 6, the rotational force is transmitted from the drive shaft 62 to the rotation shaft 56 of the developer transport member 55.

Figure 8:
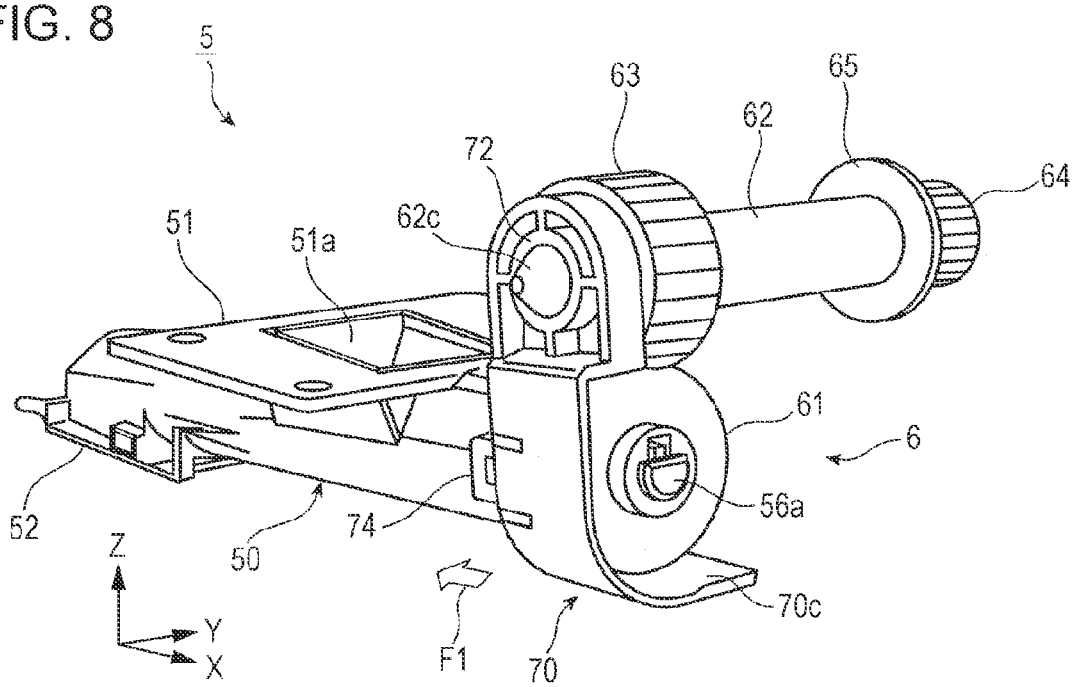
FIG. 8 is a perspective view of part of the developer replenishment device (a transport pipe, the drive transmission device, and so forth) illustrated in FIG. 4 seen from a direction at a certain angle.
Figure 9:
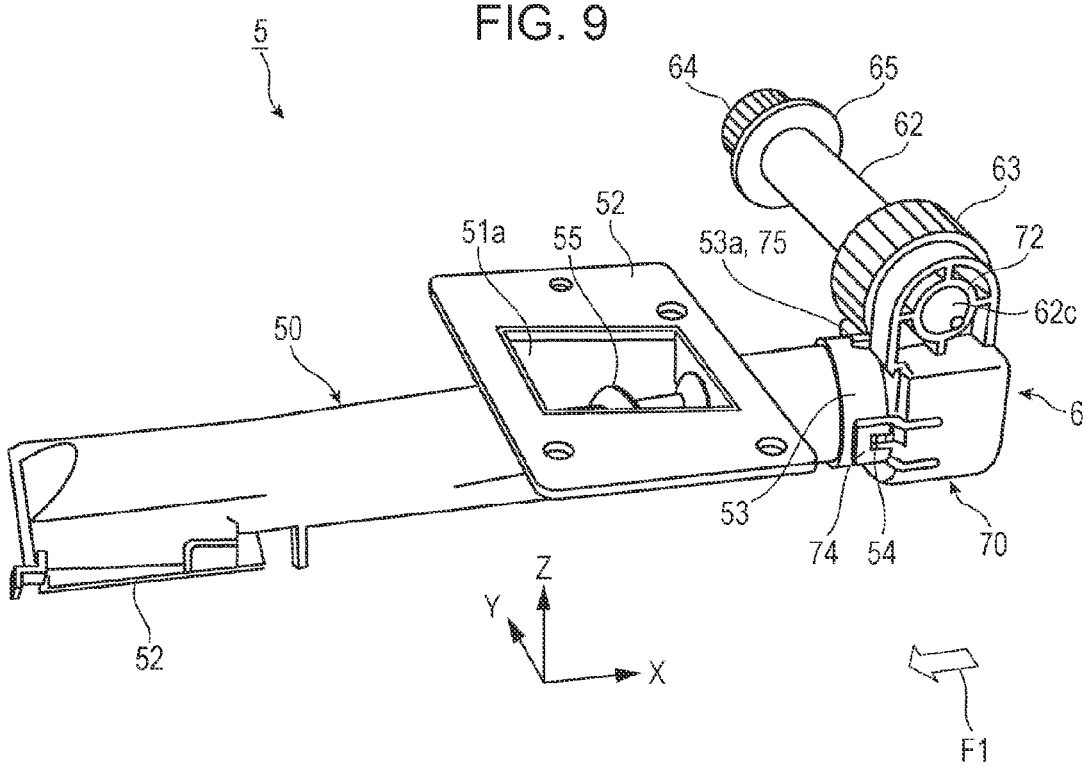
Figure 10:
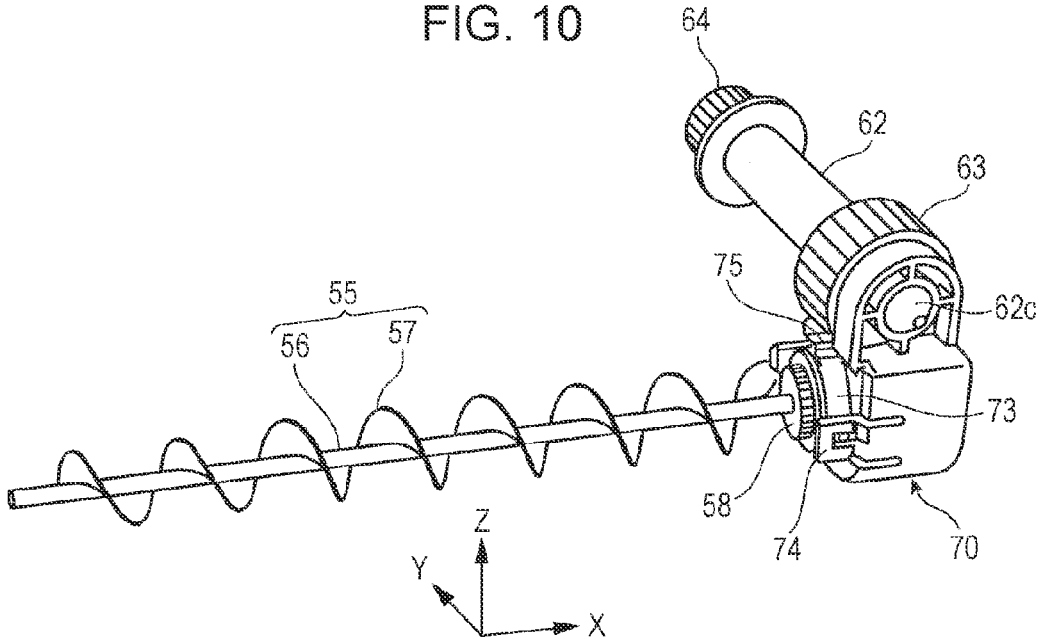
FIG. 10 is a perspective view of part of the developer replenishment device illustrated in FIG. 9 (with the transport pipe removed)

In the drive transmission device 6, orientations of teeth of the helical gears used for the drive receiving gear 61 and the drive transmitting gear 63 are desirably set such that, when the drive receiving gear 61 and the drive transmitting gear 63 are engaged with each other and rotate, a force F1 is generated in a direction in which the drive transmitting gear 63 presses the drive receiving gear 61 toward the transport pipe 50 (for example, a direction indicated by an arrow F1 in FIGS. 6, and 8, for example). With the above-described setting, a state in which the drive receiving gear 61 is pressed by the drive transmitting gear 63 toward the transport pipe 50 is maintained while the rotational force is being transmitted. Thus, the bearing member 70 is pressed against the transport pipe 50 through the first bearing 71 and the rotation shaft 56 of the developer transport member 55 to which the drive receiving gear 61 is secured. As a result, the bearing member 70 is more precisely positioned relative to the transport pipe 50 also during transmission of the rotational force. This facilitates maintaining of transmission of the rotational force.

With the developer transport device 5 equipped with the drive transmission device 6, as described above, the rotational force is transmitted to the rotation shaft 56 of the developer transport member 55 using the drive transmission device 6. This allows the developer to be stably transported through the transport space S of the transport pipe 50 using the developer transport member 55. Accordingly, in the image forming apparatus 1, the developing device 24 is stably replenished with the developer for replenishment from the developer replenishment device 4 through the developer transport device 5. Furthermore, since the developer transport device 5 stably transports the developer to the developing device 24 so as to replenish the developing device 24, the image forming operation is also stably performed.

Other Exemplary Embodiments

In the first exemplary embodiment, a device that transports the developer between the developer replenishment device 4 and the developing device 24 of the image forming apparatus 1 is described as an example of the developer transport device 5. However, the developer transport device may be, for example, a device that transports the developer between other components of the image forming apparatus 1 as long as the developer transport device uses a structure (drive transmission device 6) in which the rotational force is transmitted through gears, the axes of which are non-parallel and do not intersect each other.

In the drive transmission device 6 according to the first exemplary embodiment, the drive receiving gear 61 and the drive transmitting gear 63 may use gears other than helical gears. Also in the drive transmission device 6, it is sufficient that the positioning protrusion 75 and the cut portion 53*a* are in a paired relationship. For example, a positioning protrusion may be formed on the coupling portion 53 of the transport pipe 50 and the cut portion 53*a* may be formed in the coupling portion 73 of the bearing member 70.

In the first exemplary embodiment, for example, the developer transport device 5 uses the drive transmission device 6 as the drive transmission structure. The drive transmission device 6 includes gears, the axes of which are non-parallel and do not intersect each other, to transmit the rotational force. The drive transmission device 6 may be used as a drive transmission structure for a device other than the developer transport device 5 (may be used for an apparatus other than the image forming apparatus 1).

Forms and the like of the image forming apparatus 1 are not particularly limited to the structures exemplified in the first exemplary embodiment. The image forming apparatus may be another form of an image forming apparatus as long as the image forming apparatus is equipped with the developer transport device using the drive transmission device 6.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer transport device comprising:

a developer transport member having a transport portion and a driven shaft, the transport portion being formed in the developer transport member and transporting a developer, the driven shaft having a drive receiving gear attached to the driven shaft and a first shaft portion near the drive receiving gear, a rotational force being transmitted to the drive receiving gear;

a transport pipe having a transport space formed in the transport pipe, the transport space housing at least part of the developer transport member, the transport portion being formed in the part of the developer transport member, the developer being transported through the transport space;

a drive shaft having a drive transmitting gear attached to the drive shaft and a second shaft portion near the drive transmitting gear, the drive transmitting gear being engaged with the drive receiving gear so as to transmit the rotational force; and a bearing member having a first bearing and a second bearing, the first bearing supporting the first shaft portion, and the second bearing supporting the second shaft portion, wherein, the axis of the drive shaft does not intersect and is non-parallel to the axis of the driven shaft of the developer transport member, and wherein the first bearing and the second bearing are integrally formed with the bearing member, and wherein the second bearing is arranged on an outer side of the drive transmitting gear in a drive transmitting direction along an axis direction of the drive shaft.

2. The developer transport device according to claim 1, wherein the transport pipe has an end and a first coupling portion at the end of the transport pipe, the first coupling portion being engaged with the bearing member so as to connect the transport pipe to the bearing member, wherein the bearing member has a second coupling portion being engaged with the first coupling portion so as to connect the bearing member to the transport pipe, wherein the first coupling portion has one of a protrusion and a cut, and the second coupling portion has the other one of the protrusion and the cut, and wherein the protrusion and the cut are disposed in a paired relationship such that, when the first coupling portion and the second coupling portion are brought into engagement with each other, the protrusion is fitted into the cut so as to position the first coupling portion and the second coupling portion relative to each other.

3. The developer transport device according to claim 2, wherein the drive receiving gear and the drive transmitting gear are helical gears, and wherein the helical gears each have teeth, orientations of the teeth being set such that, when the drive receiving gear and the drive transmitting gear are engaged with each other and rotate, a force is generated, the force causing the drive receiving gear to be pressed by the drive transmitting gear toward the transport pipe.

4. An image forming apparatus comprising:

an image forming unit that forms an image made of a developer; and the developer transport device according to claim 1.

* * * * *